US005744747A

United States Patent [19]

Renaud-Bezot et al.

[11] Patent Number: 5,744,747

[45] Date of Patent: Apr. 28, 1998

[54] SLUG GENERATING CHARGE

[75] Inventors: Jean-Luc Renaud-Bezot, Bourges; Laurent Chauveau, Sennercay; Bernard Ceyrat, Bourges, all of France

[73] Assignee: Giat Industries, Versailles, France

[21] Appl. No.: 917,542

[22] Filed: Aug. 26, 1997

Related U.S. Application Data

[63] Continuation of Ser. No. 719,421, Sep. 24, 1996, abandoned.

[30] Foreign Application Priority Data

Oct. 20, 1995 [FR] France ..... 95 12337

[51] Int. Cl.[6] ..... F42B 12/10

[52] U.S. Cl. ..... 102/476; 102/501

[58] Field of Search ..... 102/306–310, 102/476, 501

[56] References Cited

U.S. PATENT DOCUMENTS

| | | | |
|---|---|---|---|
| 3,188,955 | 6/1965 | Brown . | |
| 3,913,488 | 10/1975 | Dunetz et al. | 102/501 |
| 4,922,825 | 5/1990 | Aubry et al. | 102/476 |
| 4,974,515 | 12/1990 | Busch et al. | 102/476 |
| 5,033,387 | 7/1991 | Lips | 102/476 |
| 5,090,324 | 2/1992 | Bocker et al. | 102/476 |
| 5,155,296 | 10/1992 | Michaluk | 102/476 |

FOREIGN PATENT DOCUMENTS

| | | | |
|---|---|---|---|
| A-1 280 513 | 11/1961 | France . | |
| A-2 627 580 | 8/1989 | France . | |
| A-2 657 156 | 7/1991 | France . | |
| A-2-681 677 | 3/1993 | France . | |
| 4213318 | 10/1993 | Germany | 102/476 |
| WO 90/02918 | 3/1990 | WIPO . | |

*Primary Examiner*—Harold J. Tudor
*Attorney, Agent, or Firm*—Oliff & Berridge, PLC

[57] ABSTRACT

The invention relates to a slug generating charge incorporating an explosive charge arranged in an envelope and a liner intended to be set into motion by the detonation of the explosive. The liner, whose thickness decreases between a central part and its periphery, is in contact with the envelope. A plate is placed between the explosive charge and the liner. The plate is of a diameter equal to the inner diameter of the envelope and is in contact with the liner at least at the latter's thinned peripheral part. The material of the plate is selected such that it reduces the velocity transmitted to the peripheral part of the liner by the explosive charge upon its ignition.

7 Claims, 2 Drawing Sheets

SLUG GENERATING CHARGE

This is a Continuation of application Ser. No. 08/719,421 filed Sep. 24, 1996, now abandoned.

BACKGROUND OF THE INVENTION

1. Field of the Invention

The technical scope of the invention is that of slug generating charges.

2. Description of the Related Art

Slug generating charges generally comprise an explosive charge arranged in an envelope upon which a liner roughly in the shape of a spherical cap is applied.

When the explosive detonates, the liner is set into motion by the incidental pressure wave. It deforms, turning inside out like "the finger of a glove". That is, it is transformed into a projectile (or slug) whose forward part is formed by the axial zone of the liner and the rear part is a skirt formed by the periphery of the liner.

French Patent No. 2627580 discloses such a slug generating charge.

So as to improve the distribution of the masses of the slug thus formed, the liner is generally sought to be given a thickness which decreases from its middle part to its periphery.

In fact, such an arrangement enables the center of gravity of the slug to be distanced from its rear part, thus increasing the static margin (distance between the center of gravity and the center of the aerodynamic forces) and the aerodynamic stability.

However, the mass of the periphery part of the liner runs the risk, in this case, of becoming too weak thus causing the skirt to fold forward towards the slug, thus reducing its stability.

SUMMARY OF THE INVENTION

The aim of the invention is to propose a slug generating charge which does not suffer from such drawbacks.

The invention thus proposes a slug generating charge which generates a slug having improved aerodynamic stability.

Stability is improved thanks to the presence of means which ensure that the skirt generated by the deformation of the peripheral part of the liner does not fold forward towards the front of the slug, even if this peripheral part is of reduced thickness.

The subject of the invention is thus a slug generating charge incorporating an explosive charge arranged in an envelope and a liner intended to be set into motion by the detonation of the explosive, a liner whose thickness decreases between a central part and its periphery in contact with the envelope, this charge being characterised in that it comprises a plate placed between the explosive charge and the liner, and a plate which is of a diameter equal to the inner diameter of the envelope and which is in contact with the liner at least at the latter's thinned peripheral part. The constitutive material of the plate being selected such that it reduces the velocity transmitted to the peripheral part of the liner by the explosive charge upon its ignition.

The constitutive material of the plate is advantageously of a density which is less than or equal to the constitutive material of the liner and has a Hugoniot maximum pressure greater than or equal to 0.1 GPa.

The total mass of the plate will preferably be less than that of the liner.

The mass of the plate can therefore lie between 2% and 15% of the mass of the liner.

According to a variant embodiment, the plate can be of a ring shape.

The plate will advantageously be of a thickness which decreases regularly from its outer diameter to its axial part.

The liner can be made of tantalum and the constitutive material of the plate can be chosen from among the following: aluminium, iron, steel, copper, molybdenum.

BRIEF DESCRIPTION OF THE DRAWINGS

The invention will be better understood after reading the description of the particular embodiments, description made in reference to the appended drawings, in which.

DESCRIPTION OF PREFERRED EMBODIMENTS

Figure 1:
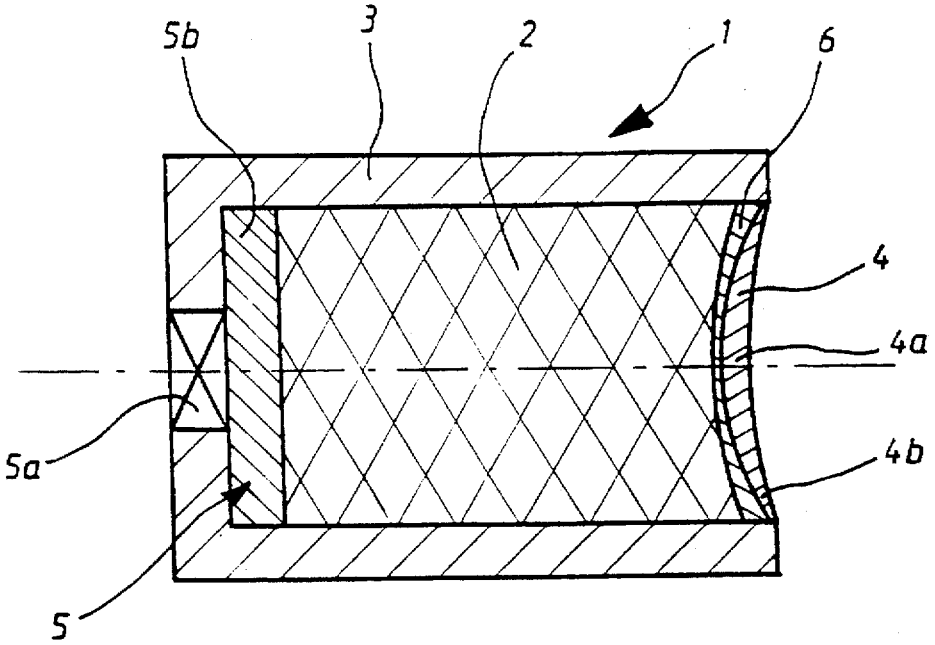
FIG. 1 shows a longitudinal section view of a slug generating charge according to the invention.

With reference to FIG. 1, a charge 1 according to the invention comprises an explosive charge 2 arranged in an envelope 3 and a liner 4 intended to be set into motion by the detonation of the explosive 2.

The charge 1 also comprises priming means 5 of a known type, formed for example of a primer **5*a* and relay explosive 5*b***.

Means to shape the detonation wave can also be provided or priming means can be used which generate a plane wave.

Such priming means are known to one having ordinary skill in the art, they do not form part of the present invention and thus will not be described in further detail.

The liner 4 decreases in thickness between a central part **4*a* and a peripheral part 4*b* in contact with the envelope 3**.

According to the invention, the charge 1 comprises a plate 6 which is arranged between the explosive charge 2 and the liner 4.

The diameter of the plate 6 is equal to the inner diameter of the envelope 2 and is in contact with the liner 4.

The liner 4 is attached to the plate 6, for example, by bonding.

The constitutive material of the plate 6 will be chosen such that it reduces the velocity transmitted by the explosive charge 2 to the liner 4 upon ignition.

In practical terms, the objective is to locally reduce this velocity by a few m/s (from a local projection velocity of the material which is generally in the region of 2000 to 2500 m/s).

Such a reduction prevents the skirt, formed by the peripheral part **4*b* of the liner 4**, from folding over.

FIG. **1*b* shows a slug 7** generated by the liner of a charge according to prior art.

The slug comprises a rear skirt 8 which is folded over the body of the slug 7, thus reducing its length and aerodynamic stability.

Figure 2:
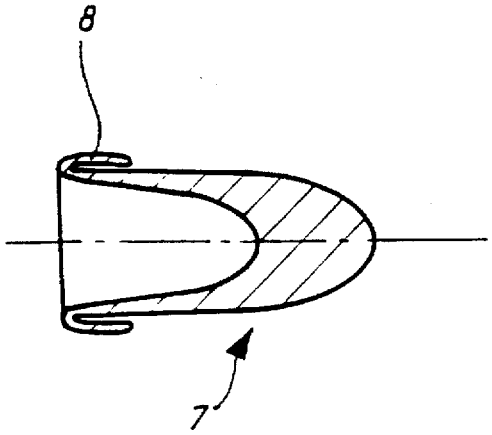
FIG. 2 PRIOR ART
FIG. 2 shows a longitudinal section view of a slug generated by the charge according to the invention.
Figure 3:
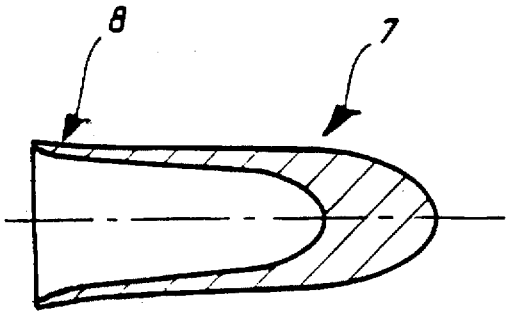
FIG. 3 shows a longitudinal section view of a slug generates by a charge according to prior art.

FIG. 2 shows a slug 7 generated by the charge 1 according to the invention. The reduction in projection velocity which is ensured by the plate 6 enables the deformation of the peripheral part 4b of the liner to be slowed down, thus ensuring the formation of a skirt 8 which is not folded over the slug 7.

When the slug is being formed, the plate 6 becomes detached from the liner 4 which continues on its trajectory alone.

Practically speaking, a material will be chosen to make the plate 6 which has a density lower than or equal to that of the material forming the liner 4 and a Hugoniot maximum pressure greater than or equal to 0.1 GPa.

The Hugoniot maximum pressure is well known to the one having ordinary skill in the art. It corresponds, for a given material, to the elastic limit of the material under uniaxial compression stress.

The plate will also be given a total mass which will be less than that of the liner. This in order not to excessively reduce the energy transmitted by the explosive charge 2 to the liner 4.

The shock wave is thus transmitted to the liner almost without absorption. Only the local velocity of the liner is slightly reduced at its periphery 4b because of the distribution at this level of the quantities of movement between the plate and the liner.

Advantageously, the plate will be given a mass of between 2% and 15% of the liner mass.

One having ordinary skill in the art will easily determine the type of material and the geometric characteristics of the plate (variation of its thickness) according to the characteristics of the liner 4 as well as of the explosive charge 2.

Generally speaking, the thickness of the plate will steadily decrease from its outer diameter to its axial part.

In fact, the reduction in velocity must be at its maximum level with the periphery 4b of the liner and be almost at a nil level with the central part 4a.

In the event that the liner is made of tantalum, the constitutive material of the plate 6 can be of aluminium, iron, steel, copper or molybdenum.

Figure 4:
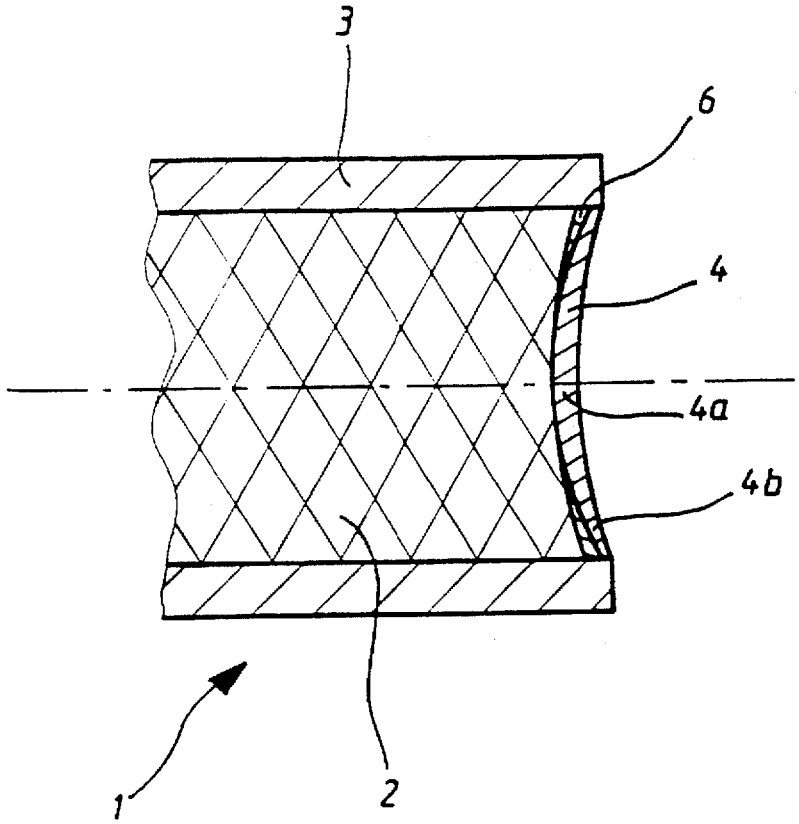
FIG. 4 shows a partial section of a variant embodiment.

FIG. 4 shows a variant embodiment of the invention in which the plate 6 is of a ring shape.

The implementation of such a plate is easier as the deformations of the plate are less substantial during machining.

No reduction in the velocity of the shock wave is to be feared with the central part 4a of the liner. The peripheral part 4b of the liner which forms the skirt is, however, slowed down.

By way of example, a slug generating charge can be made which comprises a ring shaped plate in aluminium applied onto a liner made of tantalum. The plate being around 1 mm thick at its periphery whereas the liner opposite is around 2 mm thick.

We claim:

1. A slug generating charge comprising:

an explosive charge arranged in an envelope;

having only two layers that comprise a metal liner set into motion by the detonation of the explosive, the metal liner having a circularly uniform thickness that decreases between a central part and its periphery and which is in contact with the envelope; and a metal plate placed between the explosive charge and the metal liner, the metal plate having a diameter equal to an inner diameter of the envelope, the metal plate being in contact with at least a thinned peripheral part of the metal liner, the constitutive material and geometric characteristics of the metal plate being selected such that it reduces the velocity transmitted to the peripheral part of the metal liner relative to the central part of the metal liner by the explosive charge upon its ignition;

wherein upon detonation, the metal plate becomes detached from the metal liner.

2. A slug generating charge according to claim 1, wherein the constitutive material of the metal plate is of a density which is less than or equal to the constitutive material of the metal liner and has a Hugoniot maximum pressure greater than or equal to 0.1 GPa.

3. A slug generating charge according to claim 1, wherein the total mass of the metal plate is less than that of the metal liner.

4. A slug generating charge according to claim 3, wherein the mass of the metal plate lies between 2% and 15% of the mass of the metal liner.

5. A slug generating charge according to claim 1, wherein the metal plate is of a ring shape.

6. A slug generating charge according to claim 1, wherein the metal plate is of a thickness which decreases from an outer diameter to an axial part of the metal liner.

7. A slug generating charge according to claim 1, wherein the metal liner is made of tantalum and the constitutive material of the metal plate is chosen from one of aluminum, iron, steel, copper and molybdenum.

* * * * *